US010207272B2

(12) United States Patent
Dozortsev

(10) Patent No.: US 10,207,272 B2
(45) Date of Patent: Feb. 19, 2019

(54) METHOD AND DEVICE FOR PLACEMENT OF MICROSCOPIC SAMPLE INTO THE TUBE

(71) Applicant: VitroSolution LLC, San Diego, CA (US)

(72) Inventor: Dmitri Dozortsev, Katy, TX (US)

(73) Assignee: VitroSolutions, LLC, San Diego, CA (US)

( * ) Notice: Subject to any disclaimer, the term of this patent is extended or adjusted under 35 U.S.C. 154(b) by 160 days.

(21) Appl. No.: 15/130,988

(22) Filed: Apr. 17, 2016

(65) Prior Publication Data

US 2016/0303568 A1 Oct. 20, 2016

Related U.S. Application Data

(60) Provisional application No. 62/149,617, filed on Apr. 19, 2015.

(51) Int. Cl.
*B01L 9/00* (2006.01)
*B01L 9/06* (2006.01)

(52) U.S. Cl.
CPC ..... *B01L 9/06* (2013.01); *B01L 2200/025* (2013.01); *B01L 2300/0861* (2013.01)

(58) Field of Classification Search
USPC ..... 422/500, 503, 400, 405
See application file for complete search history.

(56) References Cited

U.S. PATENT DOCUMENTS 2,532,604 A * 12/1950 Carski ..... B65B 43/54 211/69
3,649,462 A * 3/1972 Jessup ..... B01L 9/06 422/510
3,722,789 A * 3/1973 Kennedy ..... B04B 5/0421 494/17
4,221,324 A * 9/1980 Frey ..... B04B 5/0421 494/10
4,479,720 A * 10/1984 Mochida ..... B01F 9/0001 366/214
5,710,381 A 1/1998 Atwood et al.
6,971,506 B2 * 12/2005 Hassinen ..... G01N 35/04 198/803.14
9,211,543 B2 * 12/2015 Ohga ..... B01L 9/06

* cited by examiner

*Primary Examiner* — Nina Bhat
(74) *Attorney, Agent, or Firm* — Premium IP Services, P.C.; Khanh T. Glatzel

(57) ABSTRACT

The non-vertical tube holder enables visual control for transferring a microscopic sample into the test-tube, decreasing the chance of the sample loss. The tube holder may also be used for a tube transportation to the sample testing facility.

14 Claims, 1 Drawing Sheet

METHOD AND DEVICE FOR PLACEMENT OF MICROSCOPIC SAMPLE INTO THE TUBE

CROSS-REFERENCE TO RELATED APPLICATIONS

This application claims priority of U.S. Provisional Patent Application Ser. No. 62/149,617 filed on Apr. 19, 2015.

FIELD OF INVENTION

The present invention in general relates to working with microscopic samples of cells in clinical or research laboratory.

BACKGROUND OF THE INVENTION

Preimplantation embryo genetic testing is a process wherein a sample containing one or several cells is taken using an inverted microscope and micromanipulator and then tested to determine if the respective embryo is chromosomally (genetically) or metabolically normal.

After the sample is taken from an embryo it remains in the drop under oil until it is manually moved into the testing tube with a small amount of solution under control of a dissecting microscope.

This sample transfer represents a considerable challenge to the operator for two reasons. One is that holding a small tube with one hand, while a pipette with a sample in another hand limits operator's ability to focus a dissecting microscope on the sample.

Merely placing a sample onto the edge of a Petri dish solves this problem only partially, because the tube still can wiggle considerably.

Another problem is matching the tube and a sample numbers. Usually there are several samples from several biopsied embryos. It is critical that the sample would be placed into the corresponding tube number. However, the tube is usually too small to place a number on it in such way that it can be readily observed under the microscope without obstructing the view inside of the tube.

As a result, an operator has limited opportunity to verify that the right sample goes into the right tube leading to errors.

In fact, it has been reported that this type of errors is the leading cause of misdiagnosis in preimplantation genetics.

SUMMARY OF THE INVENTION

According to the present invention, tube is held in the disclosed device at the angle facilitating the handling and improving the control needed in the process of transferring cells, including single cells.

The method includes placing a drop of media on the lower wall of the tube to enable visually control of the sample transfer into the tube to assure that it was successful.

Observing the number on the dish with the sample immediately prior observing the number on the holder which corresponds to the number of the tube assures that the tube will contain a correct sample. The holders may be stackable, which facilitates sample transportation to the testing laboratory.

DETAILED DESCRIPTION OF THE INVENTION

The device holds the tube in a predictable position that frees an operator's hand to focus on the sample. Since the tube is placed at the angle, it makes it possible to place the drop of the solution on the lower wall of the tube, rather than on the bottom, so that it can be readily seen by an operator. The disclosed device can hold at least one tube.

Note that the drop placement of the lower wall of the tube creates another important distinction from the current process. Currently the small amount of the solution is added to all test tubes before they are placed into position to receive the sample. As a result, by the time the tube is placed in a position to receive a sample, the drop of the solution may be found anywhere in the tube and in most cases it slips to the bottom where sample cannot be observed during the subsequent transfer.

The method of the present invention provides for an optional placement of the drop into the tube, after it is already inserted into the holder in a position to receive the sample. This makes it possible to assure that the drop would be in an expected and convenient location by the time of the sample transfer.

The device has a large surface so that the number corresponding to the tube number can be placed on the device without obstructing the view within the tube.

Furthermore, this number can be readily verified under dissecting microscope by an operator during the transfer from the biopsy drop to the drop within the tube.

The device may also accommodate a label with a patient's name or another identifier.

Once the sample is transferred, it may remain in the device that can be used for transportation to the testing laboratory.

Several devices can be stocked on top of each other to make handling more convenient.

Figure 1:
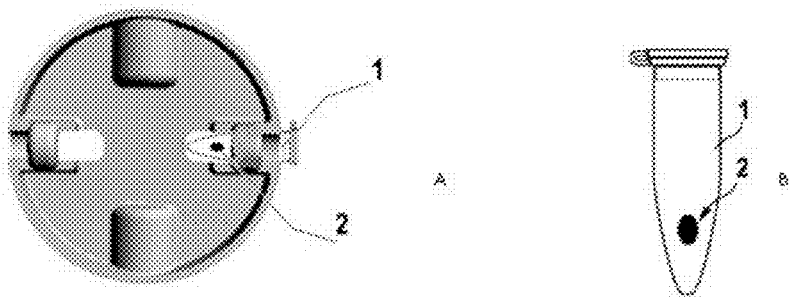
FIG. 1*a* provides the top view of the disclosed device with an inserted test-tube (1) containing a drop of the solution on the lower wall (2) and FIG. 1*b* provides a separate view of the tube (1) and the drop of the solution (2). It must be appreciated that the device may be made of the clear material transparent to light.
Figure 2:
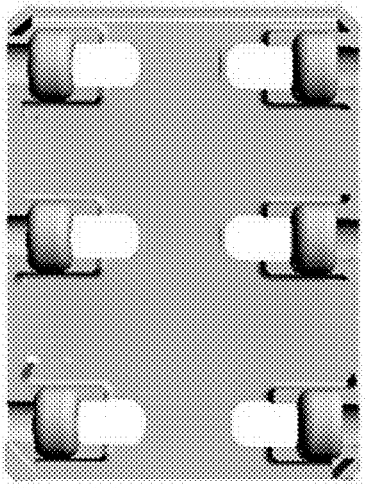
FIG. 2 shows the top view of another preferred embodiment of the device, wherein the device holds more than 2 samples. It must be appreciated that the device may made of the clear material transparent to light.
Figure 3:
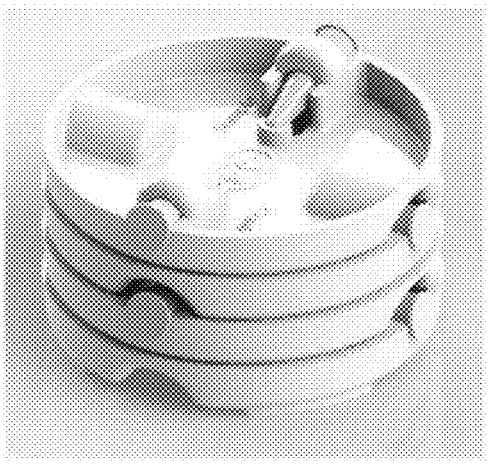
FIG. 3 shows the device of FIG. 1*a* stacked on the top of other devices for storage and transportation. The angle of the tube can be appreciated. It must be appreciated that the device may be made of the clear material transparent to light.
Figure 4:
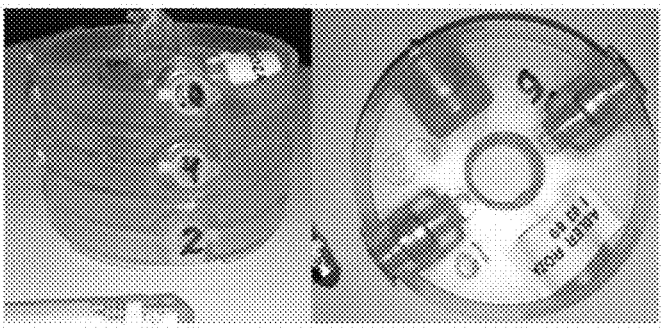
FIG. 4 shows the device of device of FIG. 1*a* with the label. It must be appreciated that the device may be made of the clear material transparent to light.

What is claimed is:

1. A device to hold a tube for receiving samples of the cells, comprising:

a base in a generally flat shape;

a tube housing to hold a tube comprising:

a holding element to hold the tube upon assembly, the holding element is sized to hold the tube in a stable position and not to extend to the entire length of the tube;

an opening in a substantially rounded shape on the holding element, the opening sized to fit a tube, wherein the tube housing is raised above the body of the base, wherein the holding element is secured to the base and raised at an angle such that upon assembly of the tube into the device, the axis of the tube forms an angle with the base of less than 90 degrees, and wherein upon assembly of a tube, the tube bottom end is unobstructed; and a cut out on the base situated at a position on the base to correspond with the tube bottom end upon assembly of the tube into the device.

2. The device of claim 1, wherein the angle is more than 90 degrees.

3. The device of claim 1, wherein the holding element is secured to the base such that it allows adjustment of the tube angle.

4. The device of claim 1, wherein the device has more than one test tube housing.

5. The device of claim 1, wherein the device further comprises at least one arch rising above the flat base.

6. The device of claim 5, wherein the device is stacked on top of at least one other device for transportation.

7. The device of claim 1, wherein the test tube housing is configured to house an Eppendorf test tube.

8. The device of claim 1, wherein the test tube housing is configured to house a micro-centrifuge tube.

9. The device of claim 1, wherein the flat base further comprises an opening at the center of the flat base to enable faster cooling of the sample.

10. A method for placing a sample into a test tube, comprising:

inserting the test tube into the device of claim 1; and placing a drop of a solution into the test tube.

11. The method of claim 10, wherein the drop of the solution is placed on the wall of the tube adjacent to the bottom of the flat base.

12. The method of claim 10, wherein a number corresponding to the sample is placed on said device such that it can be seen under the microscope.

13. The method of claim 10, wherein the drop of a solution contains a specimen from preimplantation embryo biopsy.

14. The device of claim 1, wherein the device does not have a cut out on the base and the base is made of transparent material.

* * * * *